NOISE PREVENTION HIGH VOLTAGE RESISTIVE WIRE AND METHOD OF MANUFACTURING THE SAME

BACKGROUND OF THE INVENTION

1. Field of the Invention

The present invention relates to a noise prevention high voltage resistive wire used as ignition cords for automotive vehicles, and more specifically to an improvement of the resistive wire including terminals attached thereto.

2. Description of the Prior Art

In ignition cords used for an automotive vheicle, conventionally, the cord wire is a conductor made of a material having a high resistance such as nonmetal; the core wire is covered by an insulating material; and two metallic terminals are fixed to both free ends of the resistive wire.

The ignition cord is usually used for conducting high voltage large pulse current from a distributer to ignition plugs, and therefore, the metallic terminals are formed into a cylindrical shape so as to be appropriately connectable to ignition plugs.

FIG. 1 shows an example of prior art noise prevention high voltage resistive wires in which the reference numeral 1 denotes a high voltage resistive wire; and 2 denotes a metallic terminal 2, and 3 denotes a conductive bonding agent 3. The resistive wire 1 includes an insulating material 1*a* and a core wire 1*b*; the terminal 2 includes two caulking tabs 2*a* and a radial plate 2*b*. The terminal 2 is connected to the resistive wire 1 by caulking the two caulking tabs 2*a* onto the outer surface of the resistive wire 1 in such a way that the core wire 1*b* is in contact with the radial plate 2*b* of the terminal 2. This radial plate 2*b* is effective to secure the contact between the terminal 2 and the core wire 1*b* while increasing the contact area between the two, when the terminal 2 is fixed to the resistive wire 1. Further, in FIG. 1, an exposed end of the core wire 1*b* is bent into a hook shape so as to be sandwiched between the outer surface of the insulating material 1*a* and the inner surface of the terminal 2.

In the resistive wire as described above, however, corona discharge will readily be generated at the metallic terminals due to unstable contact between the terminal and the core wire, when a high voltage large current flows therethrough, thus often resulting in a burning trouble due to corona discharge. To overcome this problem, a method has been proposed by which a conductive bonding agent is first applied to an end of the core wire 1*b* and then the terminal 2 is fitted to the resistive wire 1 to bond the core wire end to the radial plate 2*b*.

Recently, however, there exists a tendency toward a higher ignition voltage in proportion to higher engine compression ratio with increasing engine performance in automotive vehicles. Therefore, there still exists a problem in that corona discharge is often generated at the terminals of the resistive wire. In addition, where heat-cool cycle is repeated and further vibration is applied to the resistive wire, small gaps inevitably remaining at the bonding area will inevitably produce cracks thereat, thus resulting in partial peeling-off of the bonding agent and further resistive wire burning trouble.

SUMMARY OF THE INVENTION

With these problems in mind, therefore, it is the primary object of the present invention to provide a noise prevention high voltage resistive wire provided with terminals of high reliability.

The other object of the present invention is to provide a method of manufacturing a noise prevention high voltage resistive wire, which can prevent terminal trouble induced when a high voltage large pulse current is passed therethrough.

To achieve the above-mentioned object, the noise prevention high voltage resistive wire according to the present invention comprises: (a) a high voltage resistive core wire covered by an insulating material; (b) at least one metallic cap bonded to at least one exposed core wire end with a conductive bonding agent put in said metallic cap; and (c) at least one metallic terminal fitted to at least one end of the resistive wire to which said metallic cap is bonded.

The metallic cap is cylindrical in shape and further fixed to one end of the insulating material by caulking. The metallic terminal is fixed to the metallic cap and further one end of the insulating material by caulking. That is, the metallic terminal is formed with a first tab caulked to the metallic cap and a second tab caulked to the insulating material of the resistive wire.

To achieve the above-mentioned object, a method of manufacturing a noise prevention high voltage resistive wire having a core wire and an insulating material, according to the present invention, comprises the following steps of: (a) removing the insulating material from at least one end of the resistive wire to expose at least one end of the core wire; (b) putting a conductive bonding agent into a metallic cap; (c) fitting the metallic cap to at least one end of the resistive wire at which the core wire end is exposed; (d) fitting a metallic terminal to the metallic cap fitted to the resistive wire; and (e) caulking the metallic cap to the insulating material and the metallic terminal to the metallic cap and the insulating material simultaneously.

When the bonding agent is a thermosetting resin, the bonding agent is hardened after the metallic cap has been fitted and caulked to one end of the resistive wire or after the metallic cap and the metallic terminal have both been caulked.

In the noise prevention high voltage resistive wire according to the present invention, since the core wire is sufficiently buried in the conductive bonding agent, it is possible to prevent gaps or cracks from being produced in the bonding agent, thus maintaining a stable contact condition between the core wire and the terminal for long period 10 times as long as the life of the prior art resistive wire.

BRIEF DESCRIPTION OF THE DRAWINGS

The features and advantages of the noise prevention high voltage resistive wire according to the present invention will be more clearly appreciated from the following description taken in conjunction with the accompanying drawings in which like reference numerals designate the same or similar elements throughout the figures thereof and in which.

POTENTIOMETER DEVICE

BACKGROUND OF THE INVENTION

The present invention relates to a potentiometer device. Electrical potentiometers have been known for many decades. They comprise a resistor path made of wire or carbon in circular or elongated shape and a tape member or slider movable along the resistor path and making contact therewith. Usually, the tap is manually moved and its position may be recognized.

Manual adjustment of a potentiometer takes some time, in particular if a predetermined tap position is to be made. Sometimes this delay is embarrassing. For example, in electronic musical instruments, the so-called "registration" is selected by means of potentiometers and has to be readjusted during play. The handling may be facilitated by replacing the potentiometers by sets of switches, but these, of course, have only a limited number of settings.

SUMMARY OF THE INVENTION

It is a primary object of the present invention to provide a potentiometer device which can be rapidly set to any of its potential settings.

It is a further object of the present invention to provide such a potentiometer device with means permitting display of the selected setting.

In accordance with the present invention, the potentiometer device comprises a resistor path which preferably is of the strip-shaped, elongated form. an electrically conductive film member is mounted spaced above the resistor path and may be brought in contact therewith by finger pressure, the conductive film member forming the tap terminal of the potentiometer. The tap voltage is thus supplied only during the contact or finger pressure interval, and the setting so selected is to be memorized. The most simple memory, for example, would be a sample-and-hold circuit, but it is preferred to connect the film member to the input of an analog-to-digital converter and to load the output of the latter into a RAM (random access memory) which then holds a digital value representative of the tap voltage. The number of digits of such value determines how fine the setting can be made. Light emitting diodes may be used to display the respective setting. In order to avoid floating of the A/D converter input upon release of the film member, it is preferred to have the film member connected, via a resistor, to a reference potential and to check by means of a comparator whether the actual voltage at the tap differs from said reference potential, and to start a conversion cycle upon only a predetermined difference.

The optical display is useful not only in conjunction with manual setting. Many modern electronic organs permit memorizing a registration once elaborated and reading the memorized settings into the internal memory of the organ; light emitting diode displays may be easily controlled by such externally produced signals so that the player has full control of all his registers.

Preferred embodiments of the invention are illustrated in the attached drawings and will be explained hereunder.

BRIEF DESCRIPTION OF THE DRAWINGS

Figure 1:
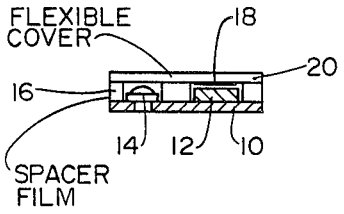
FIG. 1 is a partially broken cross-sectional view showing an example of prior-art noise prevention high voltage resistive wires.

FIG. 1 shows schematically and not to scale the input and display portion of the potentiometer device in section.

Figure 2:
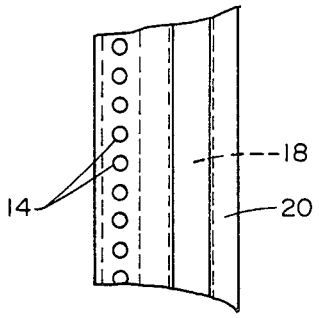
FIGS. 2(*a*), (*b*) and (*c*) are partially broken cross-sectional views for assistance in explaining the procedure

FIG. 2 is a partial plan view of the device of FIG. 1.

Figure 3:
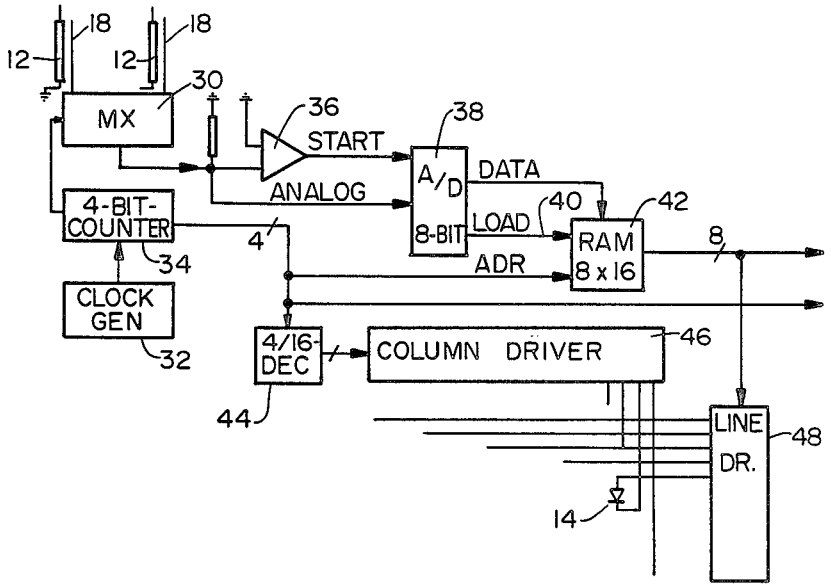

FIG. 3 is a block circuit diagram of the potentiometer device according to the invention including a plurality of input and display portions.

DETAILED DESCRIPTION OF THE PREFERRED EMBODIMENT

Referring first of FIG. 1 and FIG. 2, a support or substrate 10 carries an elongated resistor path 12 and, lateral with respect thereto, a series of light emitting diodes LED 14. A spacer film 16 is apertured for the LED and for the resistor path and insures that a film member 18 contacts resistor path 12 only upon pressure exertion upon film member 18 by exertion of pressure on flexible cover 20. The latter has an electrically conductive layer on its side facing the resistor path. The terminals of the LEDs extend through support 10 to the rear side thereof. The described layout may, of course, be modified; for example, the LEDs may be mounted centrally with respect to two parallel resistor strips, etc.

Referring now to FIG. 3, the device comprises sixteen register potentiometers of an electronic organ and allocated processing circuitry. Of the sixteen resistor/-film/LED units, only two, however, are depicted in FIG. 3. The taps are scanned in time multiplex. For this purpose, the sixteen taps are connected to the analog inputs of analog multiplexer 30 while the terminals of the sixteen resistors are respectively connected to ground potential and to a supply voltage of, say, 5 volts. Upon finger pressure on the film member, accordingly, a voltage between 0 and 5 volts is fed to the respective multiplexer input. The scanning is effected by means of clock generator 32 followed by a 4-bit counter 34.

The output of multiplexer 30 is applied to a load resistor of, say, 50 ohms and to the input of a comparator 36 whose other input is connected to ground. As long as a film member does not make contact with its resistor path, both the comparator inputs are at ground potential so that the comparator output does not produce a control signal.

Upon recognition of a potential difference at its inputs, comparator 36 produces a START signal for analog-to-digital converter 38 which converts the analog output signal of multiplexer 30 into an 8-bit digital signal. The respective address is given by counter 34, and under control of a load command on line 40, output data of the converter are written into random access memory 42. The address given by counter 34 as well as data read from memory 42 are used for the internal control of the musical instrument. Further, they are used for display control.

A decoder 44 fed with addresses from counter 34 provides a 4-into-16 conversion and supplies a column driver circuit 46 while data from RAM 42 supply a line driver circuit 48. The outputs of driver circuits 46, 48 form a matrix in the intersections of which the LEDs are connected. In result, the LED series of each resistor/display unit indicates the point next to the site where the player touched in the film member.

It will be understood that the units disposed side by side may all share a common substrate, a common spacer film, and a common transparent cover film because such a design reduces production costs. Also, the player may set all units by one single finger stroke across all sixteen units.

It will be further understood that the display may be set also if the data are not read from RAM 42 but are supplied by an exterior source.

We claim:

1. A potentiometer device comprising:

a support;

a resistor path disposed on a surface of said support and having first and second end terminals for connection, respectively, to a reference voltage and a supply voltage of a voltage source;

a plurality of lights mounted on said support adjacent to said resistor path so as to be visible;

a spacer mounted on said support adjacent to said resistor path and said plurality of lights;

an electrically conductive film means coupled to said spacer and overlying said resistor path and mounted on said support in alignment therewith but spaced therefrom, said film means for acting as a center tap terminal of said potentiometer device, said film means for elastically deforming in response to pressure so as to make electrical contact with said resistor path to form a voltage divider with the tap voltage of said electrically conductive film means relative to said reference voltage being a function of the position along said resistor path where said film means contacts said resistor path;

processing means connected to said film means and to said plurality of lights for storing said tap voltage and for lighting an appropriate group of one or more of said lights to visually indicate the relative magnitude of said tap voltage generated on said film means when said film means last touched said resistor path with said reference voltage and said supply voltage coupled to opposite ends of said resistor path;

comparator means in said processing means, said comparator means having one input coupled to said film means and coupled to a reference potential through a load resistor and having one input coupled to a predetermined reference potential from a source other than said potentiometer device, said comparator means for generating a start signal when the voltage on said film means differs from said reference potential; and wherein each said light has two terminals which must be coupled to two signals at different voltages in order to light said light and wherein said processing means comprises a random access memory and an analog-to-digital converter, said analog-to-digital converter having an analog voltage input and having a digital data output and having a control input coupled to said start signal such that conversion by said analog-to-digital converter starts when said start signal is activated, the analog voltage input of said analog-to-digital converter being coupled to said conductive film means, and said digital data output thereof being coupled to said random access memory so as to store a digital value representing said center tap voltage in said random access memory and said processing means further comprising a counter/clock means coupled to generate address signals for controlling storage of digital data from said analog to digital converter in said random access memory, and further comprising a decoder/column driver means coupled to said lights and to said counter/clock means for generating one of said two signals needed to light the appropriate light, and further comprising line driver means coupled to the output of said random access memory means to supply the other of said two signals needed to light the appropriate light.

2. A potentiometer device comprising:

a support;

a resistor path disposed on a surface of said support and having first and second end terminals for connection, respectively, to a reference voltage and a supply voltage of a voltage source;

a plurality of lights mounted on said support adjacent to said resistor path so as to be visible;

a spacer mounted on said support adjacent to said resistor path and said plurality of lights;

an electrically conductive film means coupled to said spacer and overlying said resistor path and mounted on said support in alignment therewith but spaced therefrom, said film means for acting as a center tap terminal of said potentiometer device, said film means for elastically deforming in response to pressure so as to make electrical contact with said resistor path to form a voltage divider with the tap voltage of said electrically conductive film means relative to said reference voltage being a function of the position along said resistor path where said film means contacts said resistor path;

processing means connected to said film means and to said plurality of lights for storing said tap voltage and for lighting an appropriate group of one or more of said lights to visually indicate the relative magnitude of said tap voltage generated on said film means when said film means last touched said resistor path with said reference voltage and said supply voltage coupled to opposite ends of said resistor path;

comparator means in said processing means, said comparator means having one input coupled to said film means and coupled to a reference potential through a load resistor and having one input coupled to a predetermined reference potential from a source other than said potentiometer device, said comparator means for generating a start signal when the voltage on said film means differs from said reference potential; and wherein each said light has two terminals which must be coupled to two signals at different voltages in order to light said light and wherein said processing means comprises a random access memory and an analog-to-digital converter, said analog-to-digital converter having an analog voltage input and having a digital data output and having a control input coupled to said start signal such that conversion by said analog-to-digital converter means starts when said start signal is activated, the analog voltage input of said analog-to-digital converter being coupled to said conductive film means, and said digital data output thereof being coupled to said random access memory so as to store a digital value representing said center tap voltage in said random access memory, said processing means further comprising a counter/clock means coupled to generate address signals for controlling storage of digital data from said analog-to-digital converter in said random access memory, and further comprising a decoder/column driver means coupled to said lights and to said counter/clock means for generating one of said two signals needed to light the appropriate light, and further comprising line driver means coupled to the output of said random access memory means to supply the other of said two signals needed to light the appropriate light; and further comprising a multiplexer means having a select control input coupled to said counter/clock means and having a plurality of signal channel inputs for coupling to a plurality of film means of other potentiometer devices and having an output coupled to one input of said comparator, said multiplexer means for switching the signal channel input selected by address signals from said counter/clock means to be in electrical connection with said output.

* * * * *